US006853990B1

(12) United States Patent
Thiel

(10) Patent No.: US 6,853,990 B1
(45) Date of Patent: Feb. 8, 2005

(54) FRANKING AND PREPAYMENT MACHINE

(75) Inventor: Wolfgang Thiel, Bohnsackersteig 8, 13503 Berlin (DE)

(73) Assignee: Wolfgang Thiel, Berlin (DE)

( * ) Notice: Subject to any disclaimer, the term of this patent is extended or adjusted under 35 U.S.C. 154(b) by 298 days.

(21) Appl. No.: 09/628,751

(22) Filed: Jul. 31, 2000

(30) Foreign Application Priority Data

Jul. 30, 1999 (DE) ..... 299 13 639 U

(51) Int. Cl.[7] ..... G07B 17/00
(52) U.S. Cl. ..... 705/401; 235/375
(58) Field of Search ..... 705/400, 401, 705/408, 409, 404, 405, 406, 410, 407, 60; 235/375

(56) References Cited

U.S. PATENT DOCUMENTS 4,122,532 A * 10/1978 Dlugos et al. ..... 705/409
4,780,601 A * 10/1988 Vermesse ..... 235/375
4,958,291 A * 9/1990 Mamone et al. ..... 705/404
4,980,542 A * 12/1990 Jackson et al. ..... 235/375
5,025,386 A 6/1991 Pusic
5,490,077 A * 2/1996 Freytag ..... 705/405
5,572,429 A * 11/1996 Hunter et al. ..... 705/404
5,602,743 A 2/1997 Freytag
5,606,508 A * 2/1997 Thiel ..... 705/409
5,617,519 A * 4/1997 Herbert ..... 705/408
5,717,596 A 2/1998 Bernard et al.
5,729,460 A 3/1998 Plett et al.

FOREIGN PATENT DOCUMENTS

EP 0 493 948 7/1992
EP 0513880 A2 * 11/1992
EP 0 805 419 11/1997
EP 0 805 421 11/1997
GB 2185443 A * 7/1987

OTHER PUBLICATIONS

Unknown Author, "Pitney Bowes Introduces the Accu Trac SA mail Accounting System", Feb. 1998, Business Wire, 2p.*
"Information Based Indicia Program Postal Security Device Specification," United States Postal Service, Jun. 13, 1996.

* cited by examiner

*Primary Examiner*—Thomas A. Dixon
*Assistant Examiner*—Richard Woo
(74) *Attorney, Agent, or Firm*—Schiff Hardin LLP

(57) ABSTRACT

A franking and prepayment machine, has a microprocessor that is connected to a display unit and to a keyboard, memory and interface components and digitally drives a printer module, and has an input unit that allows the input for the accounting mode. The microprocessor is programmed, given actuation or triggering of the input unit, changes the accounting mode at the user's option.

13 Claims, 4 Drawing Sheets

FRANKING AND PREPAYMENT MACHINE

BACKGROUND OF THE INVENTION

1. Field of the Invention

The present invention is directed to a franking and prepayment machine according to the type having various accounting modes.

2. Description of the Prior Art

Postage meter machines have been known since the 1920's and are still being perfected. They operate by administering a monetary amount, referred to as the allotted amount in the postage meter machine. At every franking, this allotted amount is reduced by the postage amount printed on the item for shipping. When the allotted amount has been consumed, the postage meter machine is reloaded with another allotted amount. The allotted amounts are usually debited to a customer account, so that they represent unused capital for the dwell time in the postage meter machine, since no interest is earned, or a credit was used for these amounts. This payment principle is called "pay before" by analogy with debt cards. Another disadvantage of the "pay before" principle is that the operation of reloading itself incurs outlay and/or costs. For example, the service provider or manufacturer of the postage meter machine charges a fee for reloading via a modem, as disclosed in detail in U.S. Pat. No. 5,699,415, bearing the title "Method for Matching the Database between an Electronic Postage Meter Machine and Data Center". Frequent reloading is therefore uneconomical. This, however, results in the loaded amounts being relatively large, this money residing in the postage meter machine as unused capital for a longer time.

A payment principle called "pay later" has been disclosed as an alternative in conjunction with postage meter machines. U.S. Pat. No. 5,729,460, bearing the title "Method for Payment of the Recrediting of an Electronic Postage Meter and Arrangement for the Operation of a Data Central", discloses a postage meter machine for the possibility of selectively using both payment principles, "pay before" and "pay later", whereby a credit card establishment immediately grants a credit until payment, which also improves the operation from the customer's point of view. Although the debiting ensues separately, it is nonetheless implemented in fundamentally the same way in the postage meter machine. Payment is assumed by a credit card establishment, so that the customer does not have to pay until later.

U.S. Pat. No. 5,025,386 also discloses a solution of individually changing the payment mode (coins or card) dependent on the customer wishes. The solutions described heretofore are thus different payment methods for the same mail carrier, with the standard accounting method remaining in place.

European Patent 493 948 discloses a postage meter machine that is equipped with a number of registers in a secured module for storing accounting data that refer to the use of the postage meter machine for franking items. A first set of registers relates to a specific, first service, and a second set of registers relates to a specific, second service, the specific services being selectable via the input means and the bookkeeping data of the selected service are updated. Though only one descending register for common debiting was previously required for each of the services (mail classes) of an individual mail carrier given the "pay before" payment principle, the meter disclosed in European Patent 493 948 requires respective descending registers for separate accounting for each of the services or mail carriers given the "pay before" payment principle. Of course, a third set of registers can be provided for the overall accounting, this third set relating to both register sets, namely the first and second register sets. The above-described solution, however, is only directed to the application of the accounting and payment method for different mail carriers, or different services. One service, for example, relates to a specific mail class or shipping mode that can be indicated in the usual way, as information from the stamp imprint, that is debited in a separate register set. A first or second franking imprint is correspondingly generated respectively allocated to the first or second register set. The mail class/shipping mode thus can be printed integrated with the franking stamp or as a separate selective imprint stamp for the latter.

European Application 805 419 discloses a method for data processing in a mail processing system with a postage meter machine and an arrangement that, given the same type of accounting in the postage meter machine, enables payment according to entirely different methods. Even given employment of a value card that allows a debiting in an internal register separate from the postage meter machine, the accounting is simultaneously undertaken in an accounting unit of the postage meter machine in order to enhance the security. The above-described solution thus employs the same accounting method but uses different payment methods for different mail carriers or services.

Some private mail shipping companies offer their customers billing that ensues only after the receipt or pick-up of the items to be shipped. Due to the gradual liberalization of the market, even governmental mail authorities must compete for customers. Thus, for example, Deutsche Post AG offers optional prepayment with a prepayment stamp by conventional postage meter machines, referred to as DV-prepayment for its "Infopost" (see "Infopost", Merkblatt der Deutschen Post AG, status as of Jan. 1996). In the DV-prepayment method, a prepayment note is printed on the shipping matter. The shipments franked in this way are paid upon receipt in the branch post office, or when picked up by the mail shipping company given greater quantities of mail. When agreed upon, the payment can even be debited to the customer's drawn down account. A financial prepayment by the customer is no longer required. The term "pay now" has been introduced for such a payment method.

A problem which arises more and more frequently in the practice of commercial or governmental mail dispatching is that both normal, daily mail, that can be most efficiently processed with the traditional franking method, as well as special mail, for example "Infopost", that is most economically processed with the DV-prepayment, are mixed. The exploitation of the advantages of both methods requires the acquisition and maintenance of multiple shipping equipment components that are respectively dedicated for one method. A separation of outgoing mail pending for processing is also required, which involves additional, potentially manual, work steps.

SUMMARY OF THE INVENTION

An object of the present invention is to provide a franking and prepayment machine with which a franking or a prepayment of shipping matter optionally ensues. A multipurpose postage meter machine should optionally allow the application of different accounting methods for the same mail carrier or for different mail carriers or services. Security against fraudulent manipulation should be assured given all accounting methods. The machine should offer greater flexibility in the payment and be able to process shipping matter that has not been sorted with respect to the payment mode. Another object is to provide such a franking and prepayment machine which facilitates modifications of the accounting method and/or of the rate structure.

The above object is achieved in accordance with the principles of the present invention in a franking and prepayment machine having a microprocessor connected to a display unit and an input unit and a memory in which programming instructions and data for a number of different accounting modes are stored. A user, via the input unit, can select one of these accounting modes for current usage and upon selection of an accounting mode via the input unit, the microprocessor operates according to that accounting mode using the programming instructions and data stored in the memory. Upon entry of a different selected accounting mode, the microprocessor changes to operation in the newly selected accounting mode.

Recent postage meter machines of Francotyp Postalia AG & Co. utilize digitally operating print modules such, for example, ink jet printers—for the first time world-wide—in postage meter machines of the JetMail® type, or thermal transfer printers in postage meter machines of the type T1000. It is thus fundamentally possible to print other information that has a corresponding relationship with a service of a mail carrier on a filled envelope in the region of the franking stamp or to print such information in an arbitrarily different way. It is thus easily possible to switch between private mail carriers and their services. The franking stamp imprint therefore advantageously contains a reference to the carrier and/or to the service being made use of or planned.

The franking or prepayment machine has an input stage (chip card, user interface) for entering the accounting mode and is controlled by a microcomputer system that is programmed such that it is selectively switchable among various, alternative accounting modes. An accounting always ensues before the franking. In addition to the franking, a record of the usage of the machine ensues. An alternative mode is a non-accounting mode, wherein the record about the usage of the machine is not utilized for debiting, but only for data collection. A payment method that is agreed upon with the respective carriers can be allocated to the respective modes. Since the accounting always ensues before the franking, or not at all, in the inventive postage meter machine, freedom with respect to the form of payment is assured. The payment principles of "pay before", "pay now" and "pay later" are agreed upon with the respective mail carriers or can be selectively used.

DESCRIPTION OF THE PREFERRED EMBODIMENTS

Figure 1:
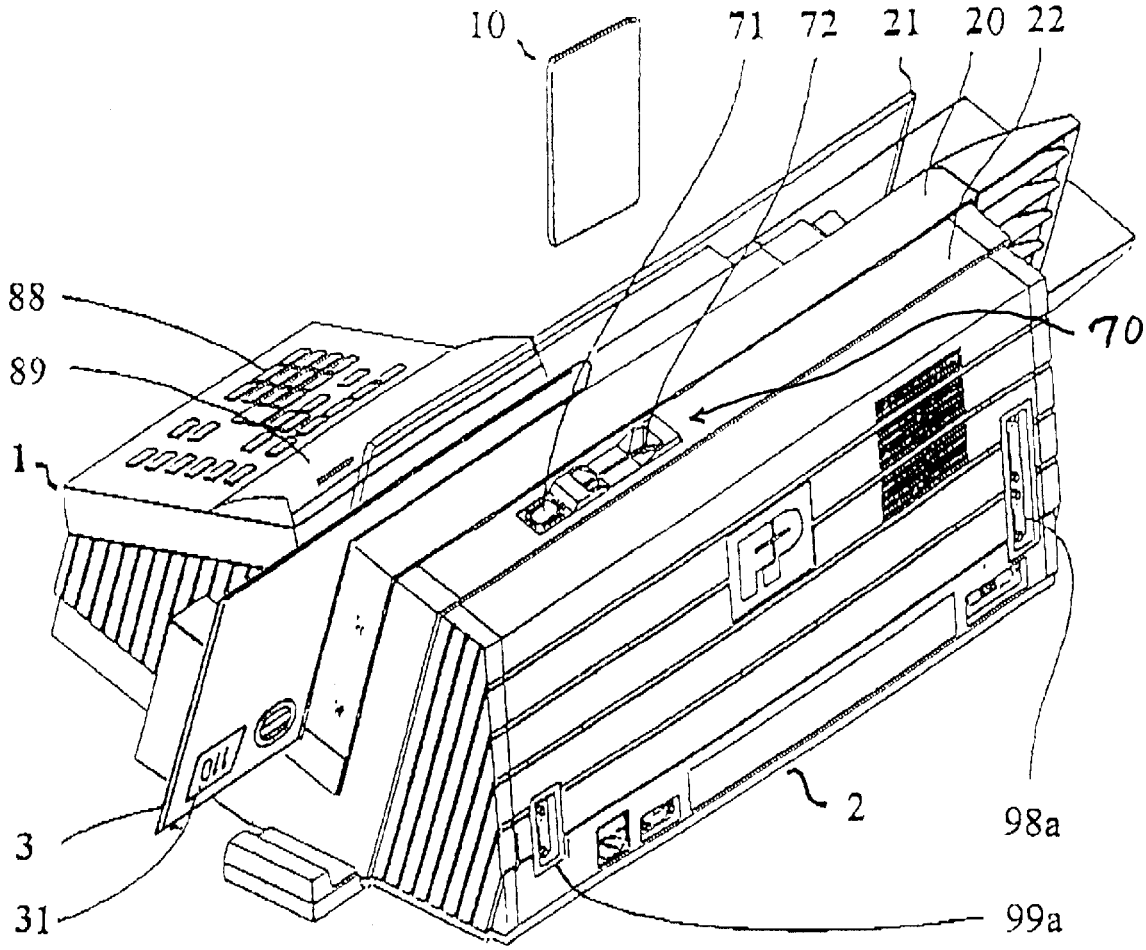
FIG. 1 is a perspective view of a postage meter machine of the JetMail® type, from behind.

FIG. 1 shows a perspective view of a postage meter machine FM1 of the JetMail® type, from behind. The postage meter machine FM1 is composed of a meter 1 and a base 2. The actuation elements 88 of a keyboard and display elements 89 in the screen of a display unit of the meter 1 form a user interface that is fashioned for entering the accounting mode as an input. Alternatively, a chip card and chip card reader can be used for entering the accounting mode. The base 2 thus is equipped with a chip card write/read unit 70 that is arranged behind the guide plate 20 and is accessible from the upper edge 22 of the housing. After the postage meter machine is turned on with the switch 71, a chip card 10 is inserted from top to bottom into the insertion slot 72. A letter 3, that is supplied standing on edge and that has its surface to be printed lying against the guide plate 20, is then printed with a franking stamp 31 in conformity with the input data. The letter admission opening is laterally limited by a transparent plate 21 and by the guide plate 20. Further stations or devices can be connected to the interfaces 98*a* and 99*a* in order to enter into a communication connection with the postage meter machine FM1. After the accounting in the aforementioned registers has ensued, the postage value is ultimately printed onto the appertaining shipping matter—the letter 3 here.

Figure 2:
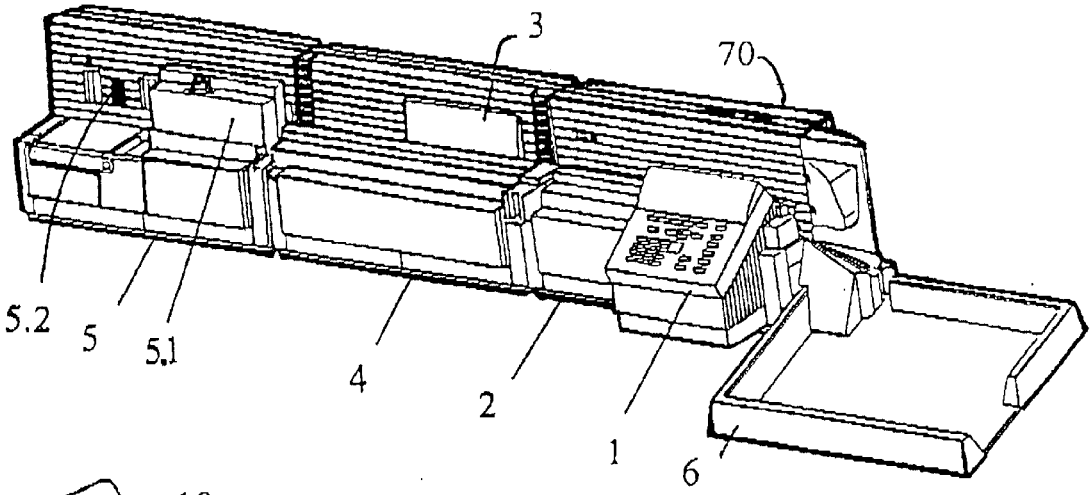
FIG. 2 is a perspective view of a mail processing system with the postage meter machine of the JetMail® type, from the front.

FIG. 2 shows a perspective view of a mail processing system with the postage meter machine FM1 of the JetMail® type, from the front. This system allows a true mixed mail processing and has been disclosed in European Patent Applications 875 864 and 901 108. A dynamic scale 4 and an automatic feeder station 5 are arranged upstream in the mail flow preceding the postage meter machine FM1, composed of the meter 1 and of a base 2. A pre-processing stage of this feeder station 5 can contain an arrangement for determining dimensions. A suitable feeder means 5 and pre-processing unit 5.1 are disclosed in detail in German Patent 196 05 017 and in the German Patent Application 19912807.3. Further details about the structural format of a suitable dynamic scale 4 can be derived from German Patent Application P 198 33 767.1-53. The control can ensue as described, for example, in German Patent Applications P 198 60 296.0 or 198 60 295.2. The weight measurement in the dynamic scale 4 preferably ensues according to German Patent Application P 198 60 294.4. An item deposit 6 is arranged downstream from the postage meter machine FM1. Since the postage values differ dependent on weight, format or shipping mode, the postage value changes automatically, particularly in mixed mail processing. The digitally drivable printing station contains an ink jet print head for a digital imprint. A thermal transfer printer is a suitable alternative for a digital imprint. A scanner 5.2 in the automatic feeder station 5 allow a scanning of a mark on the envelope for the purpose of data input. Integration of a scanner 5.2 into the scale 4 or the postage meter machine base 2 on the letter transport path to the printing station is also possible. A further data input is possible by chip card via the chip card write/read unit 70.

Figure 3:
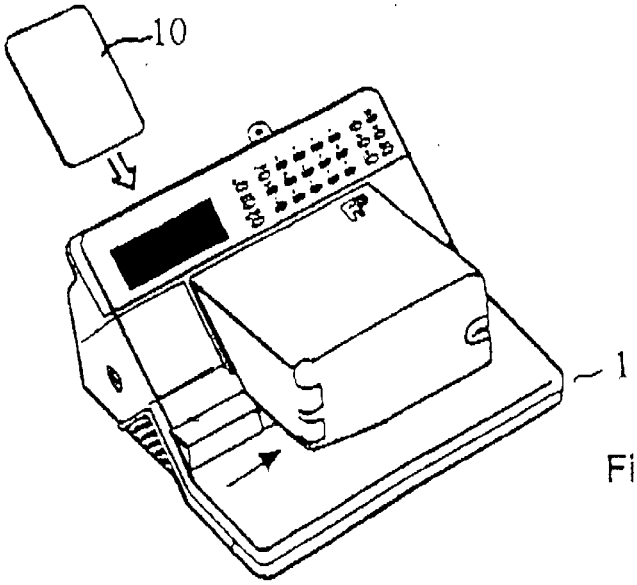
FIG. 3 is a perspective view of a postage meter machine of the type T1000, from the front.

FIG. 3 shows a perspective view of a postage meter machine FM2 of the type T1000, from the front. The meter 1 is equipped with a chip card write/read unit (not visible) and with a secured housing that surrounds all components of the postage meter machine FM2. These include a control means and the printing station, which preferably contains a thermal transfer print head. The control means has a memory for variable data and fixed data that is correspondingly fashioned to store all of the information that are printed on an envelope. A digital printing station was disclosed in East German 233 101. The generation of the corresponding print control signals for different print images proceeds, for example, from German Patent 42 24955 and from European Patent Application 576 113. A chip card 10 can be inserted into an insertion slot (not shown) from the top back. The chip card 10 can be fashioned as a carrier-associated value card with a memory that contains at least a descending register from which the postage value to be respectively franked is deducted. Digital printing methods are advantageous for assuring a fast revision of the postage values to be printed out and of the advertizing slogan as well as, potentially, the shipping mode.

Figure 4A:
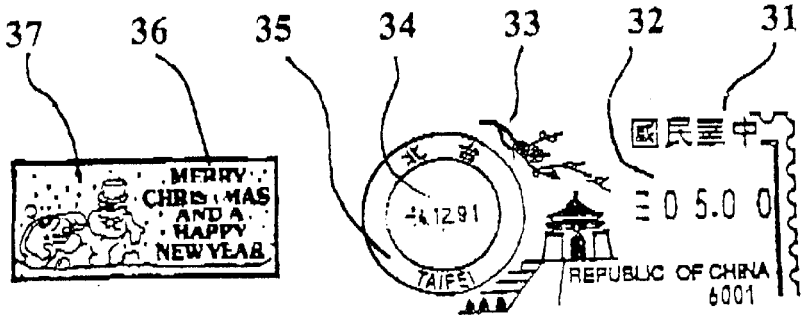
FIGS. 4*a*, 4*b*, 4*c*, 4*d* respectively illustrate various prepayment endorsements.

FIG. 4*a* shows an example of a digital imprint, which is intended to illustrate the possibilities for a large variety of imprints. A value stamp image 31 is composed of fixed pixel data and variable data for the postage value 32 and can merge in bleeding fashion into the municipal postmark image 33, composed of fixed pixel data and variable data for the city name 35, or the dispatching location and for the date data 34. The latter can include further data (not shown), for example time data. Further fixed and variable pixel data can be printed to the left next to the value and postmark image parts 31 through 35. The example shows a fixed image part 37 and a variable text part 36 that are interleaved with one another. This, however, is not meant to preclude these parts from being printed residing under one another or next to one another. A further image part (not shown) can be added, for example a marking for cryptographically securing the printed data and/or a stamp image, for example for selective printing types (endorsement) corresponding to a selected shipping type or form.

In this case, each printing is preceded by an accounting according to a first accounting mode. The first accounting mode is standard for postage meter machines permanently coupled to the "pay before" payment principle. In contrast to conventional postage meter machines, however, an elective freedom for a different accounting mode as well as for a different payment principle can be programmed in the program memory of the inventive franking and prepayment machine, as shall be explained in greater detail below.

A register set is reserved in a non-volatile memory for the first accounting mode. This register set includes a descending register RI for the remaining credit, an ascending register R2, a total resetting register R3, a first piece count register R4 for all valid franking imprints and a second piece count register R8 for all imprints, i.e. for imprints having the value "zero" as well. In the first accounting mode, the postage amount calculated or set for the shipping matter is deducted from the descending register R1 and added to an ascending register R2. The sum of the two registers R1+R2 corresponds to the sum of all allotted amounts that were loaded into the postage meter machine in a recrediting procedure and is stored in the register R3. When the remaining credit in the descending register R1 has been used, refilling thereof ensues with a reload operation that preferably ensues by means of a remote revaluing for recrediting by modem. This reloading operation can be automatically triggered when a specific minimum amount is downwardly transgressed or can lead to the display of a message for the operator. In a specific, modified embodiment, the reloading operation can sequence fully automatically with remote data transmission between a modem connected to the machine and a remote data central. A charge against the customer's account in the same amount as the reloaded amount is triggered by the data center during the course of this remote loading. Such a reloading operation has been disclosed in U.S. Pat. No. 5,699,415 entitled "Method for Matching the database between an Electronic Postage Meter Machine and Data Center".

Figure 4B:
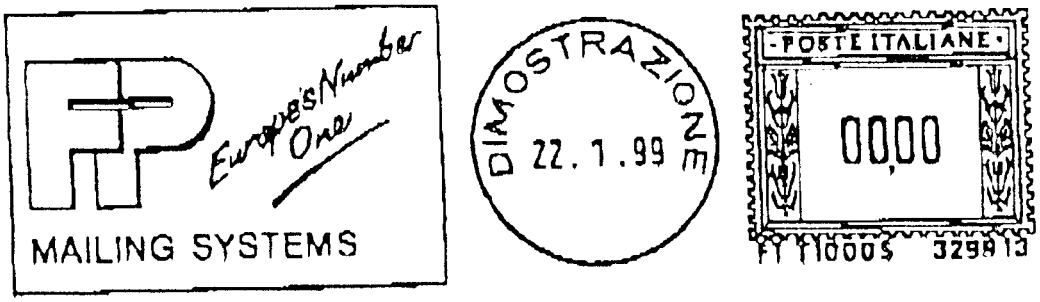

FIG. 4*b* shows an example of a digital imprint, wherein the franking imprint differs radically from that shown in FIG. 4*a* only in terms of appearance. Extremely different print images can be generated with the same machine, but the logo and/or the name of the mail carrier—for "POSTE ITALIANE" here—and the postage value always can be derived from the value stamp image.

The printing is preceded by an accounting in a second mode that counts the piece count and sums the postage value. An ongoing accounting or arbitrarily periodic accounting are possible. In this known, second accounting method, the postage value that is calculated or set for the shipping matter is added to an ascending register R2. The accounting preferably ensues in a predetermined currency unit, for example in "Euros". A descending register R1 or a total resetting register R3 then are not required. At least one piece count register exists in addition to the ascending register, preferably a piece count register R4 for all valid franking imprints and a piece count register R8 for all imprints. The imprint having the postage value "zero" corresponds to that of FIG. 4*b*. A continued counting by incrementing the counter reading by the count value "one" then ensues only in the second piece count register R8.

After expiration of a declared time interval or after exceeding a prescribed limit in the form of a value that is stored in a sixth register R6, for example in the amount of 5,000 Euros, the content of the ascending register R2 is read out and the amount of the debit that has accumulated therein is billed to the customer. This readout of the debit amount can be implemented by a person authorized by the carrier or by remote data transmission with the aforementioned technical means. This payment method is referred to as "pay later" since the billing always ensues later than the shipping service by the carrier. FIG. 4*b* shows a franking stamp imprint for a postage value in the currency unit of Euros that was created for Italy. The second accounting method is also known by the name of current account method and is used, for example, in the Netherlands and France.

Figure 4C:
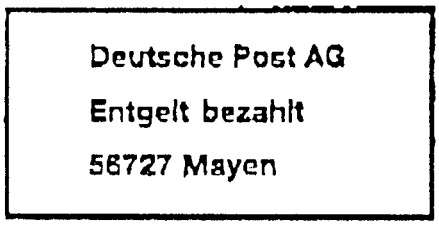
Figure 4D:
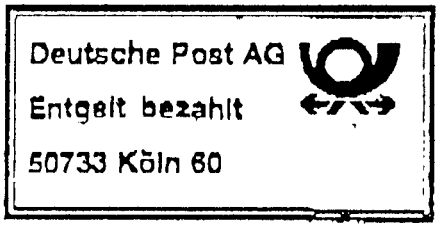

FIGS. 4*c* and 4*d* provide an example of digital imprints, whereby an accounting according to a third accounting mode can be allocated to the imprint. In a third, alternative accounting method, the accounting for the shipping matter to be sent is initiated at the time the items for shipment are handed over to the carrier. This "pay now" principle is advantageous where a number of items for shipment are to be sent under special conditions at one time (advertising mailings). For example, Deutsche Post AG offers the shipment mode "Infopost". This is an inexpensive letter service, which requires the mailings to have identical content. The mailings must be the same with respect to number and nature of the documents and enclosures. They can differ with respect to salutation, address, encoding characters and control characters. As a further condition, the items for shipment must be classified according to postal routing codes. The discounts granted for such shipping items are up to 60%. Such mailings are paid for upon receipt or when picked up. Cash or check can be used as payment means. A prepayment endorsement according to FIG. 4*c* or 4*d* must be printed on the shipping items. Additionally, it can be required to print a shipment list or a shipment receipt for the overall mailing. Storage of monetary data for accounting purposes does not necessarily ensue in this accounting mode, but only a suitable identification of the shipment items from which the accounting method clearly proceeds. A optional booking of a consecutive (running) number for more precise identification can ensue for statistical purposes.

A block circuit diagram of a postage meter machine is explained with reference to FIG. 5.

The postage meter machine has a microprocessor 46 that is connected to non-volatile memories 41, 42, 51, 52 at least for the bookkeeping data, a keyboard 45, a pixel memory 47, a clock/date module 48, a logo memory 49, a program memory 50, and interface assemblies 44, 54, 55, 58, 70. One of the interface assemblies is the chip card write/read unit 70 for the value card 10 shown in FIGS. 1 and 2. An external scale 4 and a modem 53 are connectable to the interface assembly 54. Given a postage meter machine without base, for example of the type T1000, the interface assemblies 55 and 58 can be eliminated since the security housing surrounds all assemblies, and the assembly 59 with motors, microswitches as well as sensors and the print controller 56 for the print head 57 can be directly connected to the control motherboard.

Figure 6:
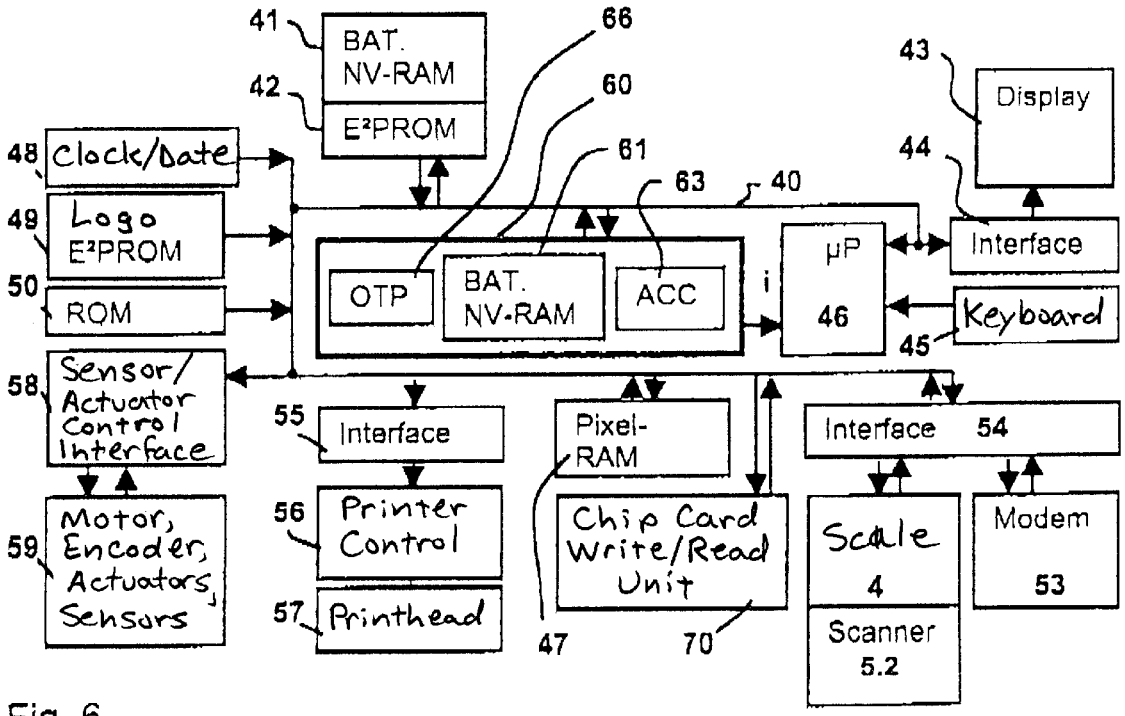
FIG. 6 is a block circuit diagram of a postage meter machine according to a second embodiment.

Given a postage meter machine with base and meter, for example of the JetMail® type, the interface assemblies 55 and 58 serve for galvanic (voltage) separation from the base. The security housing surrounds only all assemblies of the meter. FIG. 6 shows a block circuit diagram of a postage meter machine according to such a further version. The assembly 59 with motors, microswitches, sensors and the like as well as the print controller 56 for the print head 57 are components of the base and are controlled by the microprocessor 46 of the meter.

Inventively, the franking and prepayment machine contains a number of memory areas 41, 42, 51, 52 in which accounting data are redundantly stored, with the memory areas for the data of alternative accounting methods being separately addressable.

In response to actuation of one or more keys 88 the keyboard 45, or upon insertion of the card 10 in write/read unit 70, the sub-routine corresponding to the selected accounting method is called. Each sub-routine allocated to an accounting method addresses an allocated memory area for writing and reading accounting data. The non-volatile memory contains flags or pointers in the memory area by means of which each of the sub-routines allocated to an accounting method accesses a specific memory area with print data. A print routine stored in the program memory 50 effects readout of these specific memory areas and printing of a print image allocated to the accounting method.

Figure 5:
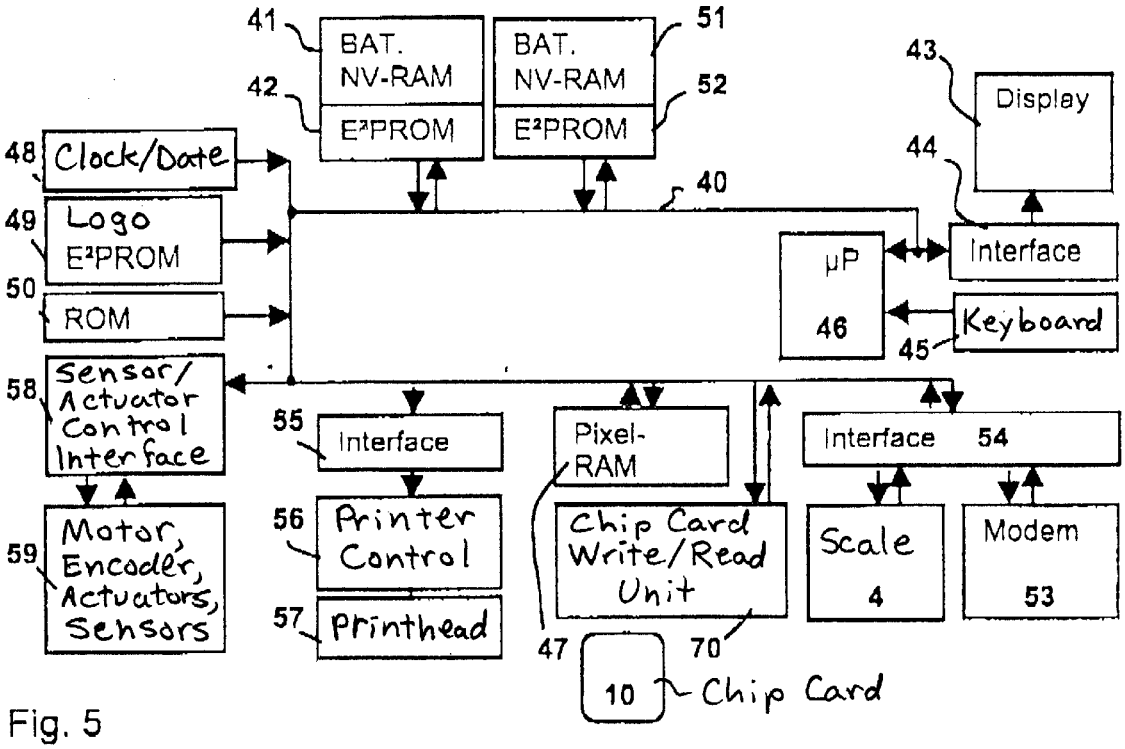
FIG. 5 is a block circuit diagram of a postage meter machine according to a first embodiment.

In the one specific embodiment shown in FIG. 5, the memory areas allocated to the accounting methods in this way are physically separate, in first memory components 41, 42 or second memory components 51, 52. These memory components preferably are a RAM 41 and an $E^2$PROM, the latter automatically assuming the data contents given outage of the system voltage. An adequate data protection is thus established. As needed and in conformity with the regulations of the postal authority, a redundant memory area or third memory in a second memory technology can be additionally utilized (not shown). When the second memory components 51, 52 are allocated to a second accounting method for the same mail carrier, then an alternative accounting method is still always available for the mail dispatch given failure of a component. It is fundamentally possible for the first memory components 41, 42 to be allocated to a first mail carrier and the second memory components 51, 52 to be allocated to a second mail carrier, whereby each has its own accounting method wherein a respective booking ensues differently. An accounting module includes the memory components 41, 42 or 51, 52. At least those memory components that contain stored accounting data and credits that are already prepaid according to the "pay before" principle in the first accounting mode are firmly, non-removably soldered on the control motherboard and are operationally connected to the microprocessor 46.

In a known way that is not shown, the first memory components 41, 42 or second memory components 51, 52 alternatively can be socketed. A plugged memory component can be removed from its socket. It is thus possible for an authorized person—with the assistance of a memory reading device—to read out the content of a memory that, for example, works according to the current account method with the pay later principle.

It is provided that different accounting modules are realized in one machine.

Alternatively, operation can be carried out with a chip card, particularly a value card. The value card (prepaid card) can be replenished at a bank terminal and functions as an electronic purse. The second memory components 51, 52 then can be omitted, since the chip card already contains a memory with a corresponding ascending register for the available monetary data (remaining credit). The readout of the remaining credit stored in the chip card can ensue with a commercially obtainable chip card reader.

In a further embodiment specific chip cards can be used on which the complete accounting is respectively implemented. Basically, the chip card can be equipped with function assemblies comparable to those arranged on the board of a meter. Given a complete accounting, the date and all other accounting data are stored in an historical sequence in the memory of the chip card 10 by the microprocessor of the chip card. An intervention into the data transfer for fraudulent manipulation of the accounting operation is thus effectively prevented. A future modification of one of the accounting systems is significantly facilitated by replacing the corresponding chip card. Advantageously, the accounting method can be pre-selected by inserting the chip card 10 into a chip card write/read unit 70. The accounting method can again be changed by actuating one of the other input means.

FIG. 6 shows a block circuit diagram of a further version of a postage meter machine. In this further version, the autonomy of the individual accounting modules is enhanced further in that, in addition to the specific memory components, a separate processor system with its own program routines is allocated to each accounting method. A security module 60 serves as a first accounting module and has a hardware accounting unit 63 and a battery-supported, non-volatile memory 61 into which a credit can be loaded by modem 53. An OTP (one-time programmable) processor 66 thereby implements security routines for recrediting as well as for securing the register data with an MAC (message authentication code). The advantage of the security module is that the checking of the dependability and the certification of the inventive franking and prepayment machine, which is done by the mail carrier, is only required for the appertaining processor system 60 and the connected printer module 55–57. The chip card 10 in combination with the chip card write/read unit 70 forms a second accounting module. The microprocessor 46 and the first memory components 41, 42 then form a third accounting module. Before using the postage meter machine, the user can thus selectively decide in favor of one or other method. An input for the corresponding change of the postage meter machine is then actuated via the actuation elements 88 of the keyboard 45.

As needed, the first memory components 41, 42 can carry out accountings for the same mail carrier as the security module or the chip card, however, an accounting ensues according to the current account method and a payment ensues according to the "pay later" principle, for example by debit note. As with the recrediting, the need for additional security is also eliminated. The change to a different accounting and payment mode requires a security module 60 or a chip card write/read unit 70 with prepaid card 10, whereby the bookkeeping is undertaken within the latter.

Of course, a number of further versions can be produced by multiple arrangement of one of the aforementioned accounting modules.

The integration of all specific memory areas in a memory module leads to another, especially economical version. The allocation of the memory areas to the accounting methods in this memory area ensues exclusively via the internal address areas. For data protection, this module should be redundantly implemented.

The input means for calling corresponding sub-routines can be realized in a large variety of ways. A special key among the keys 88, whose actuation calls the corresponding sub-routines, can be arranged in the keyboard 45 of the machine. Entering specific key combinations for calling the sub-routines is also another possible version. An input for the corresponding change of the postage meter machine can already be triggered by inserting a corresponding prepaid card 10 into the chip card write/read unit 70.

Another especially advantageous input is the automatic read-in and recognition of a corresponding information. The majority of letters are now produced at a PC. A decision can already be made at a PC as to whether a letter is part of an advertizing campaign and is therefore identified as Infopost and debited with the pay now principle, or whether it is deducted from the prorated amount as a standard letter according to the "pay before" principle. This determination can be printed as additional information on the shipping item that has not yet been accounted for. Printing in machine-readable form, for example with a bar code, is especially expedient. This imprint is scanned as it moves to the print head 57 of the machine, and the information about the selected accounting method leads to the calling of the corresponding sub-routines in the franking/prepayment machine. The system according to FIG. 2 can be fundamentally used, with the scanner 5.2 is integrated in the automatic feeder station 5 or in the dynamic scale 4. The scanner 5.2 is electrically connected to the postage meter machine via the interface 54.

Another suitable system for setting the postage meter machine to different mail carriers has been disclosed in European Application 805 419. Inventively, a corresponding freedom for selecting different accounting methods can now be realized given such a system. Alternatively, the information about the selected accounting method can also be transmitted to the franking/prepayment machine in an electronic way from the PC on which the letter was produced; this, however, assumes that the shipping matter supplied to the machine no longer change in terms of sequence.

Another version for the information input is for a postal customer who, for example, plans a more extensive advertizing mailing, to communicate with the carrier and so as to be granted a special, non-public rate. The franking/prepayment machine of the postal customer is connected to a data central for the remote transmission of accounting data and is fashioned for the reception of a special carrier rate. The carrier forwards the special rate to the franking and prepayment machine of the appertaining postal customer via the data center operated by the carrier or by a service provider. The machine identifies the mail to be dispatched according to these conditions with an information, for example a code transmitted from the data center. The microprocessor 46 is programmed to print information onto the shipping matter in order to identify the mail to be sent according to the carrier conditions. The declared accounting can also ensue according to the pay later principle, which is otherwise not granted by this carrier.

In order to be able to print the specific endorsements for the respective accounting method with the franking/prepayment machine, this machine is equipped with a digital printing method. Such printing methods in the form of thermal transfer and ink jet printers are already utilized in modern postage meter machines. Print data that represent image parts shared by all print images can thereby be deposited in a memory area that is always read out, whereas specific image data such as, for example, the text "postage paid" to be printed vertically are allocated to the specific accounting method, the "pay before" principle in this case. In the case of the "pay now" method, the same text is printed horizontally as a text to be read in a normal way. The shared image parts can contain graphic elements such as straight lines for frames or print patterns for numerals and other characters.

In another version of the inventive franking/prepayment machine, an accounting for shipping items is possible given different carriers. Most governmental postal authorities operate according to the pay before principle, for example, the largest postal organization of the world, the USPS, operates in this manner. The customer-friendly pay later principle is employed, for example, by the state-run French postal agency. Although it is actually the exception at present viewed internationally, it is to be anticipated that the private mail carriers increasingly entering the market place will also make such offers to their customers in future. The majority of private carrier companies currently active in package delivery offer their customers the "pay now" principle. However, the optional accounting according to one or other principle by a single concern is offered, for example the accounting of "Infopost" by the Deutsche Post AG, whereby the accounting preferably ensues according to the "pay now" principle, and the accounting for ordinary letter mail ensues by franking on the basis of a prepaid monetary sum "pay before".

The postal customer of the future thus has the choice between different carriers and different accounting methods. In this case, the realization of the inventive solution is configured such that separate memory areas are provided for each accounting method and each carrier. For example, ten differently addressable memory areas are needed given five different carriers that respectively offer two different accounting methods. Input means are provided that allow both the selection of the carrier as well as the selection of the accounting method. The microprocessor 46 is programmed to implement the preselection of an accounting mode in combination with the calling of a query routine for the selection of the carrier and vice versa. The preselection of a carrier results in the calling of a corresponding query routine about the accounting methods offered by this carrier. In the converse case, the preselection of an accounting method leads to the calling of a query routine for the selection of the carriers that offer this preselected accounting method. The selections that are made control the printing of an identifying endorsement of the shipping item with the specific print data.

Although modifications and changes may be suggested by those skilled in the art, it is the intention of the inventor to embody within the patent warranted hereon all changes and modifications as reasonably and properly come within the scope of his contribution to art.

I claim as my invention:

1. A franking and prepayment machine comprising:

a machine housing;

a microprocessor in said machine housing;

a digital printer module connected to and operated by said microprocessor for printing a digital imprint;

at least one memory in said machine housing connected to said microprocessor containing data and programming instructions for a plurality of different accounting modes said at least one memory including a plurality of different accounting modules respectively used for said accounting modes in said plurality of accounting modes, said accounting modules including a first module for accounting after printing said digital imprint and a second module for accounting before printing said digital imprint;

an input unit, in communication with said microprocessor, allowing arbitrary designation of an accounting mode, as a selected accounting mode, from among said plurality of accounting modes; and said microprocessor being programmed for, upon entry via said input unit of said selected accounting mode operating in the selected accounting mode using one of said first and second modules.

2. A franking and prepayment machine as claimed in claim 1 for use in franking items for delivery by different carriers, and wherein said microprocessor is programmed for using different ones of said accounting modes in said plurality of accounting modes respectively for different carriers.

3. A franking and prepayment machine as claimed in claim 1 for use in franking items to be delivered by a plurality of different carriers, and wherein said microprocessor is programmed to conduct accounting for one of said carriers in different ones of said accounting modes in said plurality of accounting modes.

4. A franking and prepayment machine as claimed in claim 1 comprising an accounting module connected to said microprocessor for undertaking bookkeeping procedures associated with said plurality of accounting modes.

5. A franking and prepayment machine as claimed in claim 1 comprising a plurality of memory components connected to said microprocessor and forming an accounting module, said memory components having data entered therein from said input unit via said microprocessor and conducting accounting according to the selected accounting mode, resulting in generation of a debit note, according to a "pay later" principle.

6. A franking and prepayment machine as claimed in claim 1 comprising a plurality of memory components connected to said microprocessor and having entries therein from said accounting unit via said microprocessor, said memory components forming an accounting module for conducting an accounting for a carrier for items to be franked by said franking and prepayment machine according to a prepayment method, with recrediting for prepayment in said prepayment method.

7. A franking and prepayment machine as claimed in claim 1 for use with a plurality of carriers for delivering items franked by said franking and prepayment machine, said carriers including at least a first carrier and a second carrier, and wherein said at least one memory includes first memory components for conducting accounting for said first mail carrier according to a first accounting mode in said plurality of accounting modes, and a plurality of second memory components for conducting accounting for said second mail carrier according to a different accounting mode in said plurality of accounting modes.

8. A franking and prepayment machine as claimed in claim 1 wherein one of said accounting modules is a chip card, and wherein said franking and prepayment machine comprises a chip card write/read unit for receiving said chip card, and said chip card, when inserted in said write/read unit, initiating said microprocessor to designate the selected accounting mode.

9. A franking and prepayment machine as claimed in claim 1 wherein one of said accounting modules is a security module.

10. A franking and prepayment machine as claimed in claim 1 wherein one of said accounting modules comprises a plurality of memory components.

11. A franking and prepayment machine as claimed in claim 1 wherein said input unit comprises a scanner for scanning an item to be franked by said franking and prepayment machine, said scanner being connected to said microprocessor, and wherein said item to be franked carries information readable by said scanner identifying one of said plurality of accounting modes, and wherein said scanner, upon reading said information, enters said one of said accounting modes as said selected accounting mode.

12. A franking and prepayment machine as claimed in claim 1 for use with a plurality of carriers for delivering items franked by said franking and prepayment machine, and wherein said input unit allows selection of one of said carriers and wherein said microprocessor is programmed for automatically selecting one of said accounting modes, as said selected accounting mode, dependent on selection of one of said carriers via said input unit.

13. A franking and prepayment machine as claimed in claim 1 comprising a display unit in communication with said microprocessor, and wherein said input unit is a keyboard having at least one actuation element for designating the selected accounting mode, and wherein said display unit displays the selected accounting mode.

* * * * *